United States Patent [19]

Boyadjieff

[11] Patent Number: 4,625,796

[45] Date of Patent: Dec. 2, 1986

[54] WELL PIPE STABBING AND BACK-UP APPARATUS

[75] Inventor: George I. Boyadjieff, Anaheim, Calif.

[73] Assignee: Varco International, Inc., Orange, Calif.

[21] Appl. No.: 718,537

[22] Filed: Apr. 1, 1985

[51] Int. Cl.[4] ..... E21B 19/20

[52] U.S. Cl. ..... 166/77.5; 166/85; 175/85; 173/164

[58] Field of Search ..... 166/77.5, 78, 85, 377–380; 175/52, 85; 173/164; 414/22

[56] References Cited

U.S. PATENT DOCUMENTS

| | | | |
|---|---|---|---|
| 2,450,934 | 10/1948 | Calhoun | 175/85 |
| 3,061,011 | 10/1962 | Paget | 166/77.5 |
| 3,312,294 | 4/1967 | Wilson | 173/164 |
| 3,351,585 | 7/1967 | Dubberke | 166/77.5 |
| 3,464,507 | 9/1969 | Alexander et al. | 175/85 |
| 4,421,179 | 12/1983 | Boyadjieff | 175/85 X |
| 4,437,524 | 3/1984 | Boyadjieff et al. | 175/52 X |
| 4,449,596 | 5/1984 | Boyadjieff | 175/85 |
| 4,458,768 | 7/1984 | Boyadjieff | 175/85 |
| 4,489,794 | 12/1984 | Boyadjieff | 175/85 |

*Primary Examiner*—Stephen J. Novosad
*Assistant Examiner*—John F. Letchford
*Attorney, Agent, or Firm*—William P. Green

[57] ABSTRACT

Apparatus for use during connection of a length of pipe to the upper end of a drill string, preferably in a top drive drilling arrangement, and including a back-up tool for retaining the upper end of the drill string against rotation as the added length of pipe is connected threadedly thereto. This back-up tool is mounted for movement between an active position for engaging and holding the upper end of the drill string and a laterally retracted position. A stabbing unit associated with the back-up tool acts to locate the additional length of pipe while it is connected to the string, and is mounted for movement with the back-up tool between the active and inactive positions of the latter, and also for movement relative to the back-up tool, in the active position of that tool, between an extended position for engaging and holding the additional length of pipe at a location offset laterally with respect to the back-up tool and a stabbing position locating the additional length of pipe in alignment with the back-up tool for connection to the string.

35 Claims, 14 Drawing Figures

FIG. 4
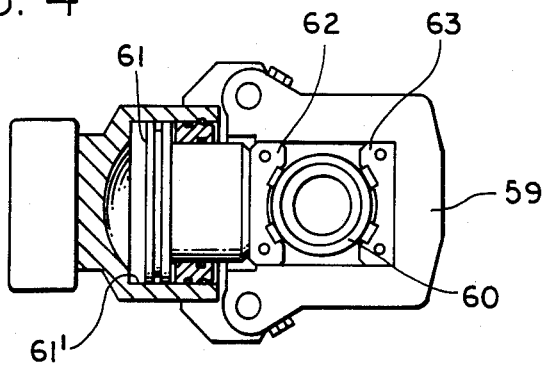
FIG. 5
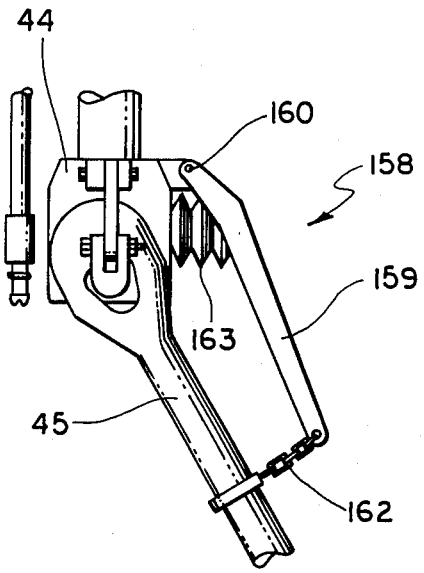
FIG. 6
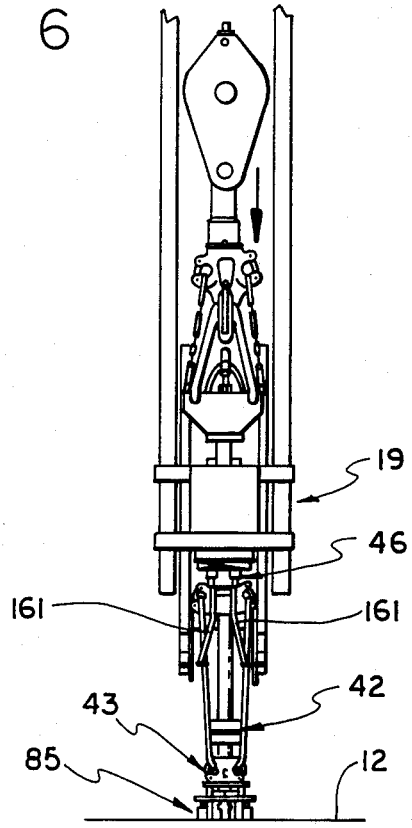
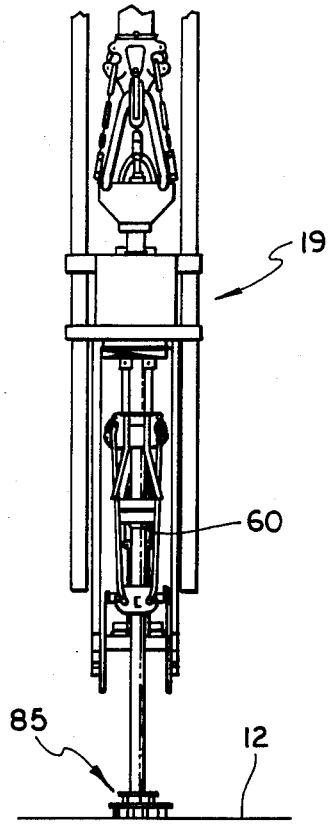
FIG. 7

FIG. 10
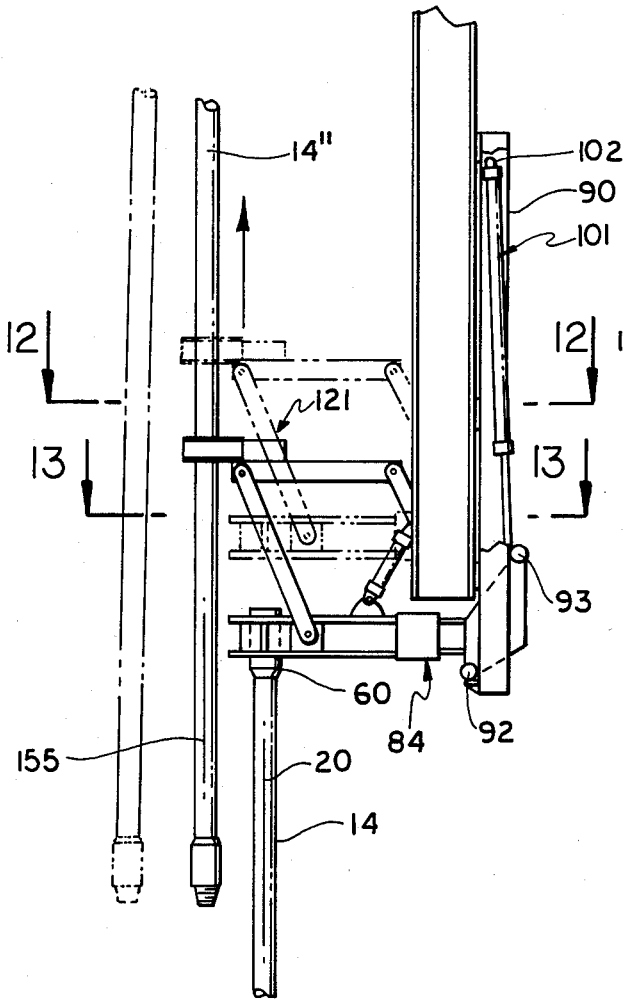
FIG. 11
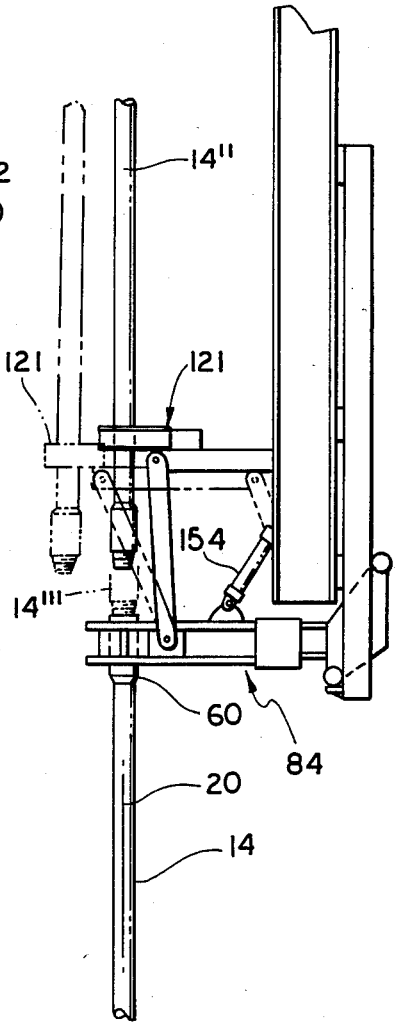
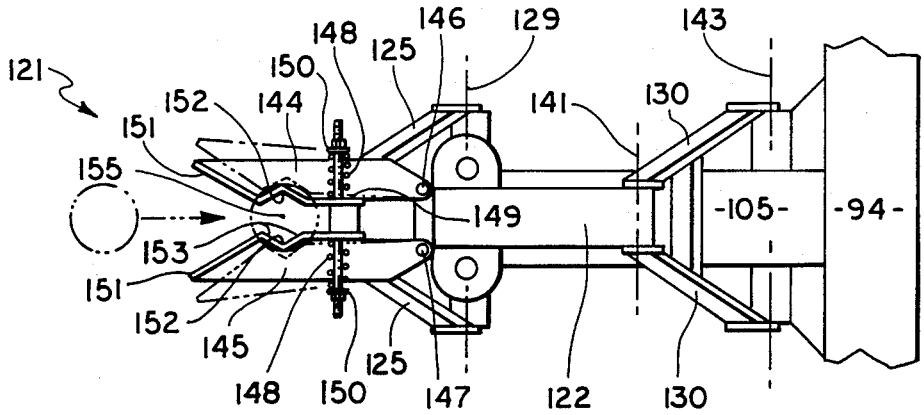
FIG. 12

FIG. 13
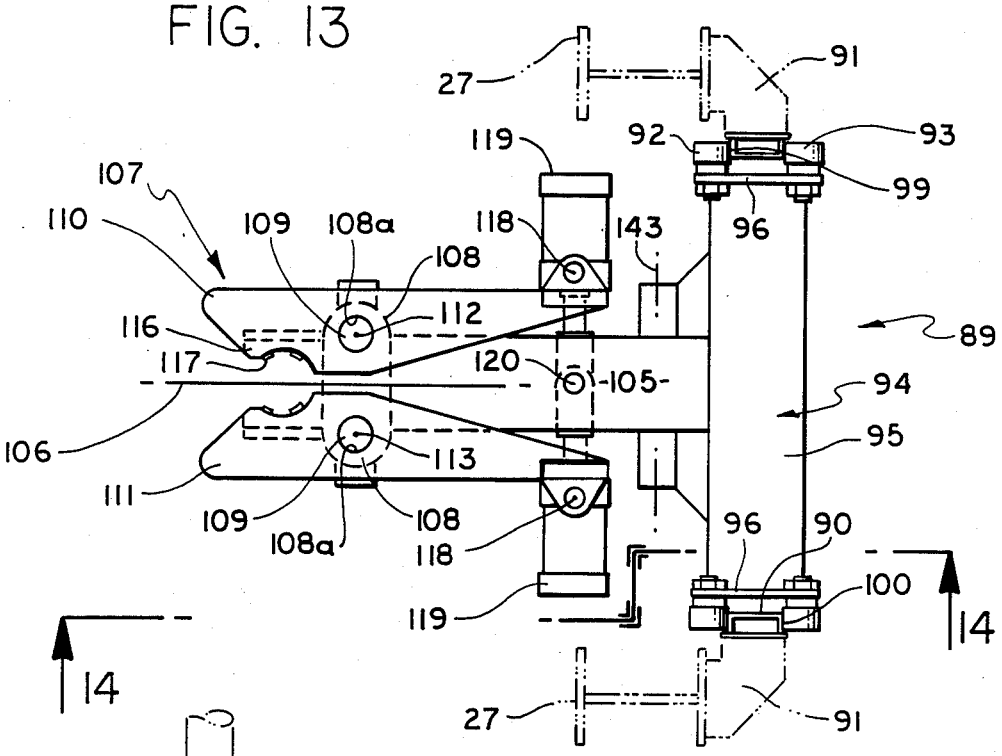
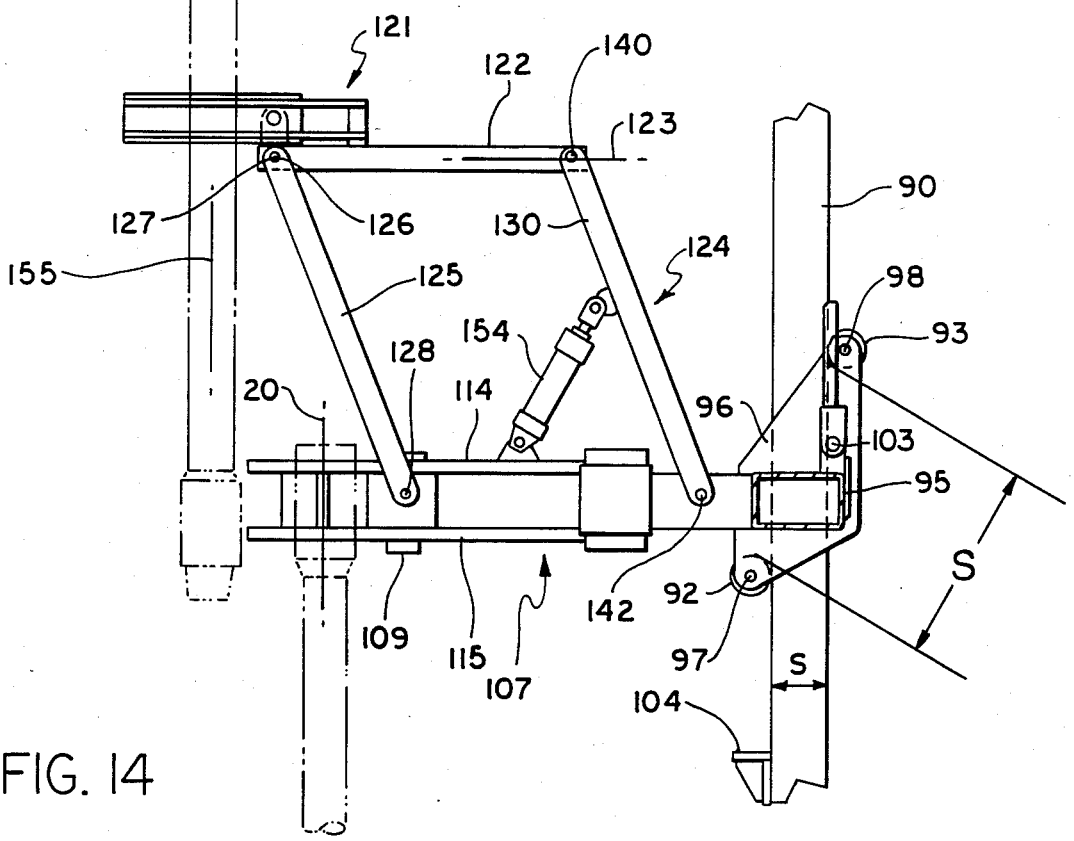
FIG. 14

WELL PIPE STABBING AND BACK-UP APPARATUS

BACKGROUND OF THE INVENTION

This invention relates to improved apparatus for assisting in the process of connecting a length of pipe to the upper end of a drill string. The invention is in some respects especially useful in a top drive drilling arrangement, and will be described primarily as applied to that use, though it will be apparent that some features of the invention may also be applicable to other types of drilling apparatus.

In my copending U.S. patent application Ser. No. 677,988 filed Dec. 4, 1984 on "Top Drive Drilling Systems", I have disclosed methods and apparatus for permitting the drill string of a top drive drilling system to be pulled upwardly off of the bottom of the hole each time that a length of pipe is to be added to the upper end of the string, in order to reduce the possibility that the string may become stuck in the hole, or, in case of an offshore well drilled from a floating vessel, to prevent damage to the string resulting from wave motion. The apparatus of that prior invention includes a back-up tool which is capable of engaging the upper threaded end of the string at an elevated location spaced above the floor of the rig and retaining the string against rotation as a length of pipe is connected threadedly to its upper end. In one form of the invention, the tong is mounted for swinging movement between an active position for engaging and holding the upper end of the string at the elevated location and a laterally retracted position in which the back-up tool remains during drilling.

SUMMARY OF THE INVENTION

The present invention provides improved apparatus which may be utilized for assisting in making a threaded connection in a drill string at an elevated location as discussed above. Equipment embodying the invention can function both to retain the upper threaded end of the tool joint against rotation and locate an additional length of pipe above and in alignment with the upper end of the string to facilitate controlled stabbing of the added length into the top of the string. For this purpose, the apparatus includes a back-up tool which is mounted for movement between active and inactive positions, and an associated stabbing unit for engaging and locating the additional length of pipe as it is connected to the string, with the stabbing unit being mounted for movement with the back-up tool between the active and inactive positions of that tool, and also for movement relative to the back-up tool between an extended position of the stabbing unit and a stabbing position thereof. The stabbing unit can initially make contact with and gain control of the additional length of pipe in the extended position of the unit, and then pull the pipe to a properly aligned stabbing position above the upper end of the string, and effectively guide the pipe as it moves downwardly into engagement with the string.

The stabbing unit may be connected to the back-up tool for generally horizontal shifting movement relative thereto between the two discussed positions of the stabbing unit, with the connection preferably being a parallelogram type mounting for the stabbing unit. The entire assembly may be mounted for swinging movement as a unit between an active position in which the back-up tool projects generally horizontally toward the axis of the well and a generally vertically extending retracted position at a side of the well. In addition, the back-up tool and stabbing unit may both be shiftable vertically in the active position of these parts, to enable the back-up tool to engage the upper end of the drill string and restrain it against rotation at any of various different levels, to thereby avoid the necessity for very accurate vertical positioning of the upper end of the string each time that another length of pipe is to be added to the string.

BRIEF DESCRIPTION OF THE DRAWINGS

The above and other features and objects of the invention will be better understood from the following detailed description of the typical embodiment illustrated in the accompanying drawings in which:

FIG. 4 is an enlarged horizontal section taken on line 4—4 of FIG. 3;

FIG. 5 is a fragmentary side view taken on the same line as FIG. 3, and showing the elevator supporting links in their laterally projecting positions;

FIG. 6 shows a portion of the apparatus of FIG. 1 after the drilling has been continued to a point at which the top drive drilling assembly has reached the rig floor;

FIG. 7 shows a next step of the overall drilling operation, with the drill string pulled upwardly from the FIG. 6 position to a predetermined elevation;

FIG. 10 is an enlarged fragmentary view showing the back-up and stabbing assembly in the FIG. 9 condition;

FIG. 11 shows a next step in which the length of pipe to be added to the string has been raised and moved by the stabbing unit a position directly above and aligned with the upper end of the drill string;

FIG. 12 is an enlarged horizontal section taken on line 12—12 of FIG. 10;

FIG. 13 is an enlarged horizontal section taken on line 13—13 of FIG. 10; and FIG. 14 is a vertical section taken on line 14—14 of FIG. 13.

DESCRIPTION OF THE PREFERRED EMBODIMENT

Figure 1:
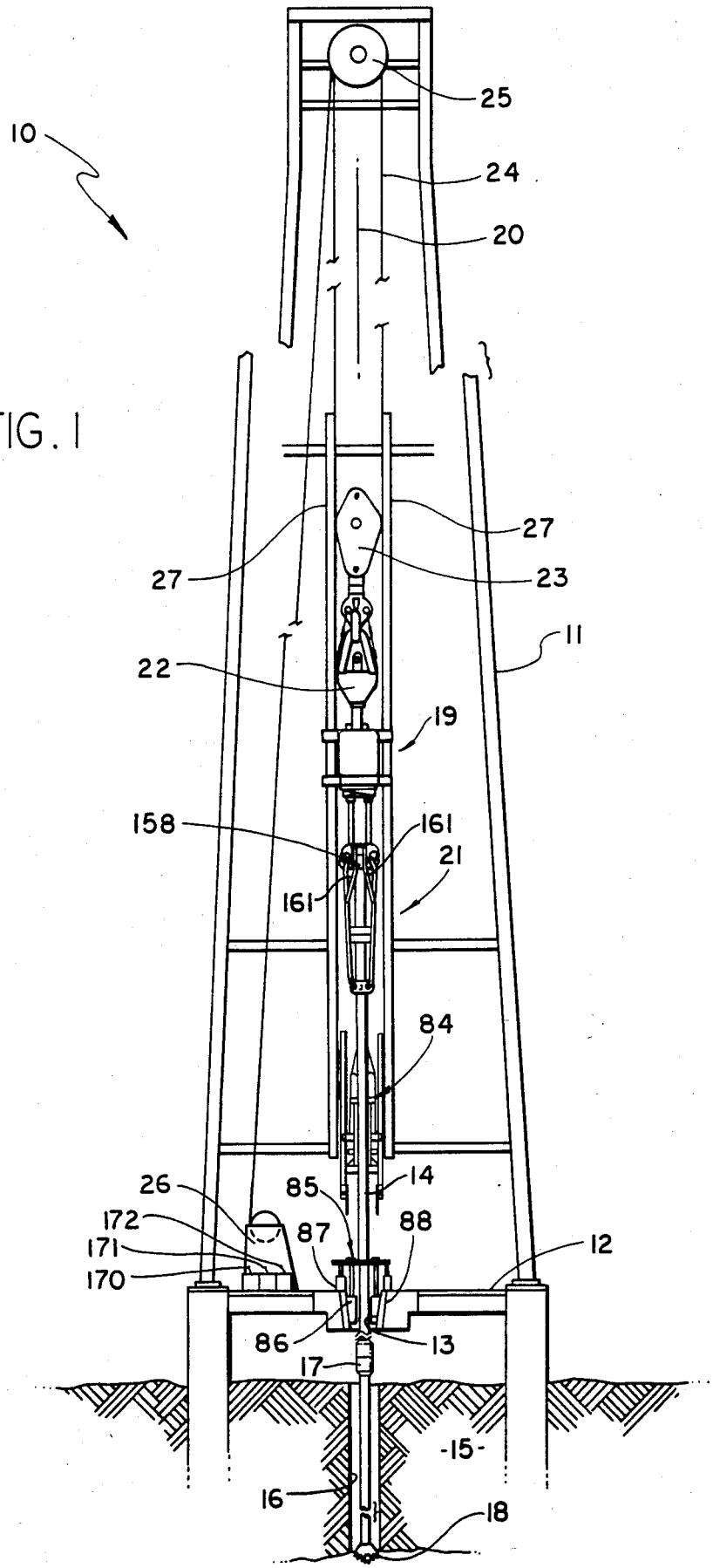
FIG. 1 is a representation of a top drive drilling system embodying the invention.

The rig 10 shown in FIG. 1 includes a derrick 11 having a rig floor 12 at its lower end containing an opening 13 through which drill string 14 extends downwardly into the earth 15 to drill a well 16. The drill string is formed in the usual manner of a large number of pipe sections interconnected at threaded joints 17 and having a bit 18 at the lower end of the string. The string is driven rotatively by a top drive drilling unit 19 which is connected to the upper end of the string and moves upwardly and downwardly therewith along the vertical axis 20 of the well. A pipe handler assembly 21 is suspended from the drilling unit, and is operable to suspend the string or a section of pipe in some conditions and to make and break threaded connections at the bottom of the drilling unit.

Figure 2:
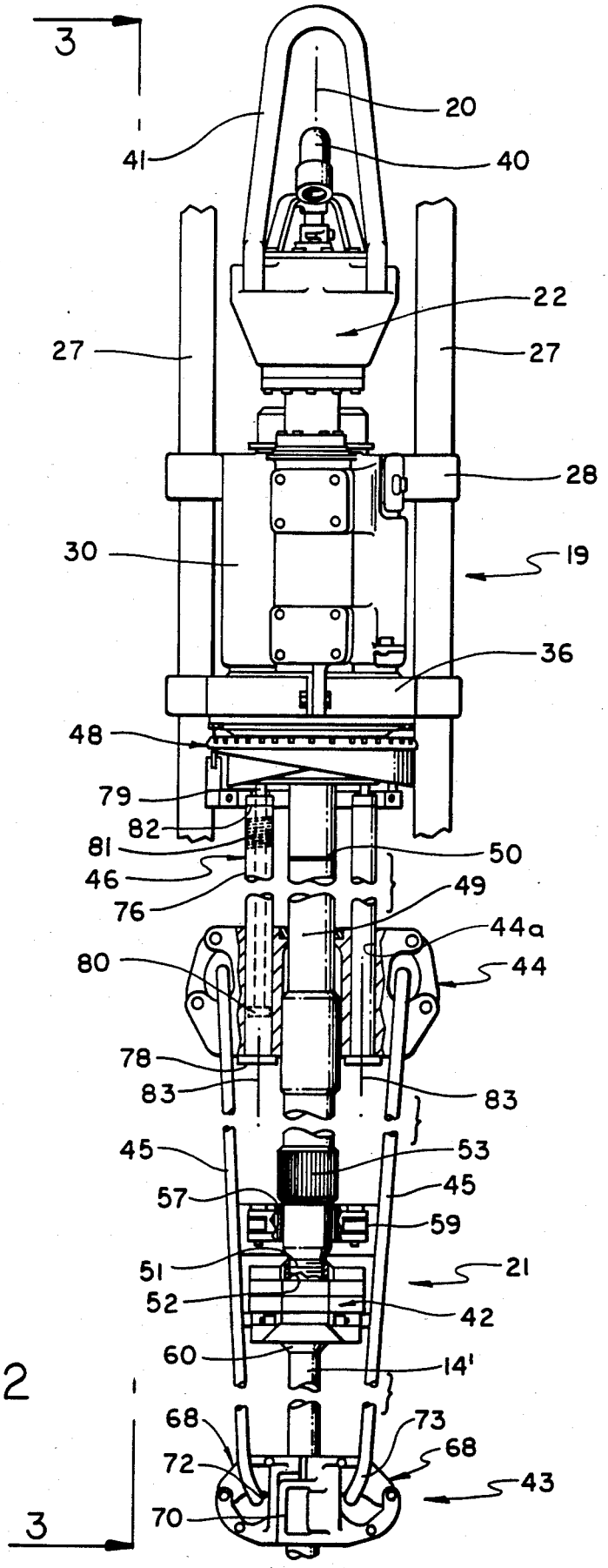
FIG. 2 is an enlarged fragmentary view corresponding to a portion of FIG. 1, with certain elements illustrated in section.

Drilling fluid is introduced into the upper end of the tubular drill string through a swivel 22 connected to the upper end of top drive unit 19, with the swivel and connected top drive unit and pipe handler being suspended from a traveling block 23 which is suspended and moved upwardly and downwardly by a line 24 connected at its upper end to a crown block 25 and actuated by conventional powered draw works 26. The drilling unit 19, pipe handler 21 and connected parts are guided for vertical movement along axis 20 by two vertical guide rails or tracks 27 rigidly attached to derrick 11. The drilling unit 19 is attached to a carriage represented at 28 (see FIGS. 2 and 3) having rollers 29 engaging and located by rails 27 and guided by those rails for vertical movement upwardly and downwardly along the rails parallel to axis 20.

Figure 3:
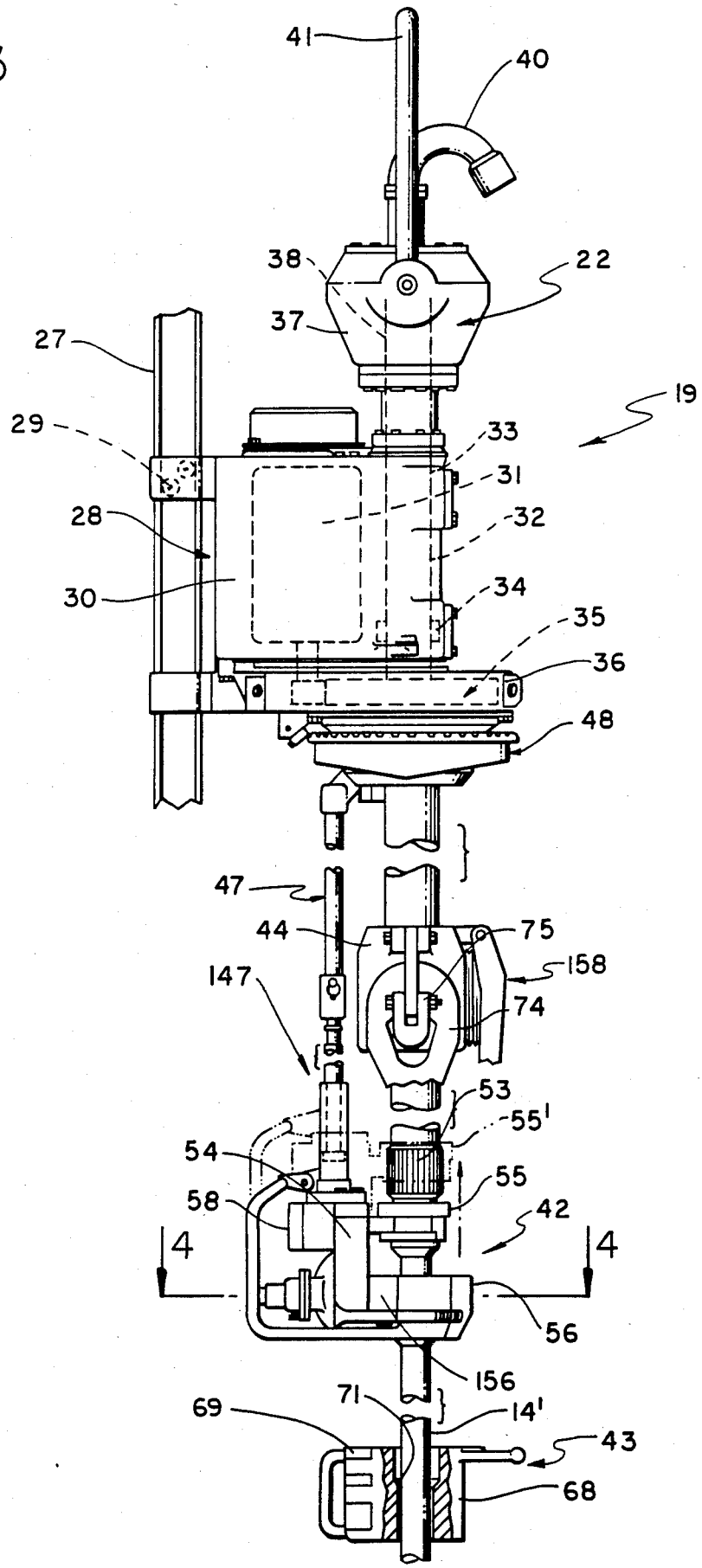
FIG. 3 is a side view taken on line 3—3 of FIG. 2.

Top drive unit 19 includes a housing 30 which is connected to carriage 28 in fixed position relative thereto during drilling and round tripping operations, and which contains a motor diagrammatically represented at 31 in FIG. 3. Housing 30 has a tubular vertical portion 32 within which a vertical tubular rotary element or pipe section 33 is journalled by bearings represented at 34 for rotation relative to the housing about the vertical axis 20 of the apparatus. The motor drives the tubular stem 33 rotatively about axis 20 through a speed reduction gear assembly represented diagrammatically at 35 and contained within a lower portion 36 of housing 30. Swivel 22 may be of conventional construction, including an outer body 37 within which a tubular element 38 connected to the upper end of the drilling unit stem 33 is rotatable, with the drilling fluid being fed downwardly through the swivel and tubular element 33 of the drilling unit into the drill string from a gooseneck 40. The swivel is suspended from the traveling block by the usual bail 41.

Pipe handler 21 is suspended by and moves upwardly and downwardly with the drilling unit 19, and includes a torque wrench 42, an elevator 43 suspended from a carrier part 44 through two links 45, a link tilting mechanism 158 for swinging the links and suspended elevator to a side of the well axis, a pair of torque arrestors 46 for retaining part 44 against rotation, and a structure 47 for supporting and actuating torque wrench 42. The pipe handler may be connected to drilling unit 19 through an assembly 48 which retains the parts of the pipe handler against rotation relative to the drilling unit during a drilling operation but may permit rotation when the drill string is detached from stem 33 of the drilling unit and is being raised or lowered by elevator 43.

Pipe handling assembly 21 includes a hollow tubular pipe section or sub 49 threadedly connected to the bottom of powered driven rotary stem 33 of the drilling unit at 50, and having an externally threaded pin portion 51 at its lower end connectible to an internal thread 52 in the upper joint end 60 of the upper section 14' of drill string 14, to enable the drilling unit to rotatively drive the drill string through the elements 33 and 49. Element 49 may have an externally splined portion 53 near its lower end for coaction with the torque wrench in making or breaking a connection with the upper end of the drill string.

Torque wrench 42 includes a rigid body structure 54 suspended from the top drive drilling unit by structure 47, and including an upper section 55 of the torque wrench and a lower section 56. Section 55 contains internal splines 57 which are located beneath and out of engagement with the splined portion 53 of element 49 in the position of FIGS. 2 and 3, and are movable upwardly into engagement with splines 53 in an upper position of the upper section of the torque wrench (see broken lines 55' in FIG. 3). In this upper position, parts 49 and 55 are keyed together by the splines to permit part 55 to apply torque about axis 20 to element 49. This torque is developed by two piston and cylinder mechanisms 58 (FIG. 3) having their cylinders rigidly connected to body 54 of the torque wrench and having their pistons connected to ears 59 of element 55 to rotate the element about axis 20. The torque wrench is power actuable upwardly and downwardly between its full line and broken line positions of FIG. 3 by a vertically extending piston and cylinder mechanism 147, whose piston is connected to the lower end of structure 47 by which the torque wrench is suspended and whose cylinder is connected to body 54 of the torque wrench.

The lower section 56 of the torque wrench includes a body 156 which is receivable about the upper internally threaded box end 60 of the top section of drill string 14 and is rigidly connected to body structure 54 of the torque wrench. A piston 61 contained within a cylinder 61' carried by the body structure 54 is actuable by fluid pressure to force a gripping jaw structure 62 within body 59 of section 56 toward and away from a second gripping jaw structure 63 to grip the upper box end 60 and retain it against rotation while element 49 is turned in either direction by upper section 55 of the torque wrench to make or break the threaded connection between element 49 and box 60.

Elevator 43 is of any conventional construction, including two body sections 68 pivoted together at 69 for opening and closing movement to enable the elevator to be placed about and removed from the drill pipe. A latching mechanism 70 releasably holds the two sections in their closed position, in which the elevator is capable of supporting the entire weight of the drill string. For that purpose, sections 68 may form together an internal annular upwardly facing shoulder 71 engageable with the enlarged joint end 60 at the upper end of the drill string to prevent downward movement of the drill string relative to the elevator. Alternatively, the elevator may be of a type containing slips for gripping and supporting the upper drill pipe section. The elevator may have loops 72 at its opposite sides engageable with the lower loop portions 73 of links 45, whose upper loops 74 engage loops 75 of carrier part 44 to suspend the elevator and drill string therefrom in certain operating conditions of the apparatus.

Each of the torque arrestors 46 includes an outer cylindrical body 76 (FIG. 2) which extends vertically through a passage in carrier part 44 and supports that carrier part by engagement of a lower flange 78 on body 76 with the underside of the carrier part. A rod 79 is connected at its upper end to the drilling unit and suspended thereby and projects downwardly into tubular body 76, and has an enlarged head 80 at its lower end bearing upwardly against a spring 81 in body 76 whose upper end bears upwardly against a shoulder 82 in body 76 to support that body, so that the upper drilling unit and rod 79 support carrier part 44 yieldingly through spring 81. The two torque arrestor assemblies extend vertically along two vertical axes 83 which are parallel to the main vertical axis 20 of the apparatus and offset at diametrically opposite sides of that axis.

The link tilting mechanism 158 includes a rigid member 159 (FIGS. 1, 3 and 5), which is connected pivotally at 160 to carrier part 44 for swinging movement about a horizontal axis between the positions of FIGS. 3 and 5. Member 159 has two arms 161 which project downwardly near the two links 45 respectively and are attached thereto by chains or other flexible connectors 162. A fluid actuated bellows 163 positioned between carrier part 44 and member 159 acts when pressurized internally to swing member 159 outwardly from its FIG. 3 position to its FIG. 5 position, with member 159 pulling the links laterally to their inclined FIG. 5 positions in which elevator 43 is displaced to a side of the well axis to engage and pick up a length of pipe.

The present invention is particularly concerned with the provision, in conjunction with the above discussed top drive drilling apparatus, of a back-up and stabbing assembly 84 for use in connecting an added length of pipe to the upper end of the string. This assembly is preferably spaced above the rig floor 12, in order to enable the drill string to be pulled off of the bottom of the well while the additional pipe is connected to the string. The necessity for adding pipe of course occurs whenever the drilling unit reaches its lowermost position adjacent the rig floor as represented in FIG. 6. As the apparatus arrives at the position, elevator 43 desirably engages a slip assembly 85 supported by the rig floor within opening 13, and is restrained by that slip assembly against further downward movement as the drilling unit 19 and the string and torque wrench 42 continue their downward movement relative to elevator 43, links 45 and carrier part 44 until the torque wrench reaches the FIG. 6 position of engagement with or closely proximate the elevator. This relative vertical movement of the parts is permitted by downward sliding movement of outer bodies 76 of torque arrestors 46 relative to part 44 and within bores **44*a* in that part in which they are slidably received. After the hole has been drilled to the depth represented in FIG. 6, the draw works is actuated to elevate the drilling unit and connected string to the position represented in FIG. 7, in which the upper internally threaded box end 60 of the string is located at a level substantially above the rig floor 12, which level is in most instances high enough that a person standing on the rig floor cannot conveniently reach box end 60 to assist in making a connection thereto. In the FIG. 6 lowermost position of the drilling unit, the upper box end 60 of the string may be spaced about two feet above the level of the rig floor, and in the FIG. 7 position the box end 60** is preferably pulled upwarldy at least about ten feet above the rig floor, and preferably between about ten and thirteen feet above the rig floor.

Slip assembly 85 is actuated, preferably hydraulically or by other power, to grip the drill string and support it at the FIG. 7 level. Prior to such actuation, the slip assembly is of course in a released condition in which it does not grip the pipe or interfere in any way with vertical movement of the drill string by the drilling unit. The slip assembly may be of any conventional construction, and is typically illustrated as including a number of tapered slips 86 actuable upwardly and downwardly by cylinders 87 relative to a slip bowl 88 between a lower position in which the slips grip and support the well pipe and an upper released position in which the drill string can be moved upwardly and downwardly without interference by the slip mechanism.

Figure 8:
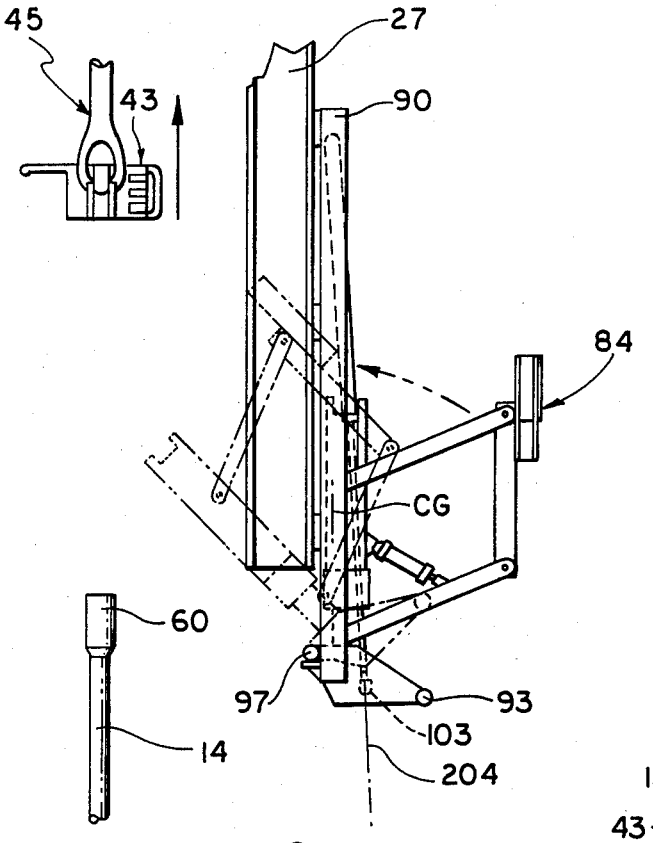
FIG. 8 shows a next step, in which the top drive drilling assembly has been detached from the drill string and is being withdrawn upwardly.
Figure 9:
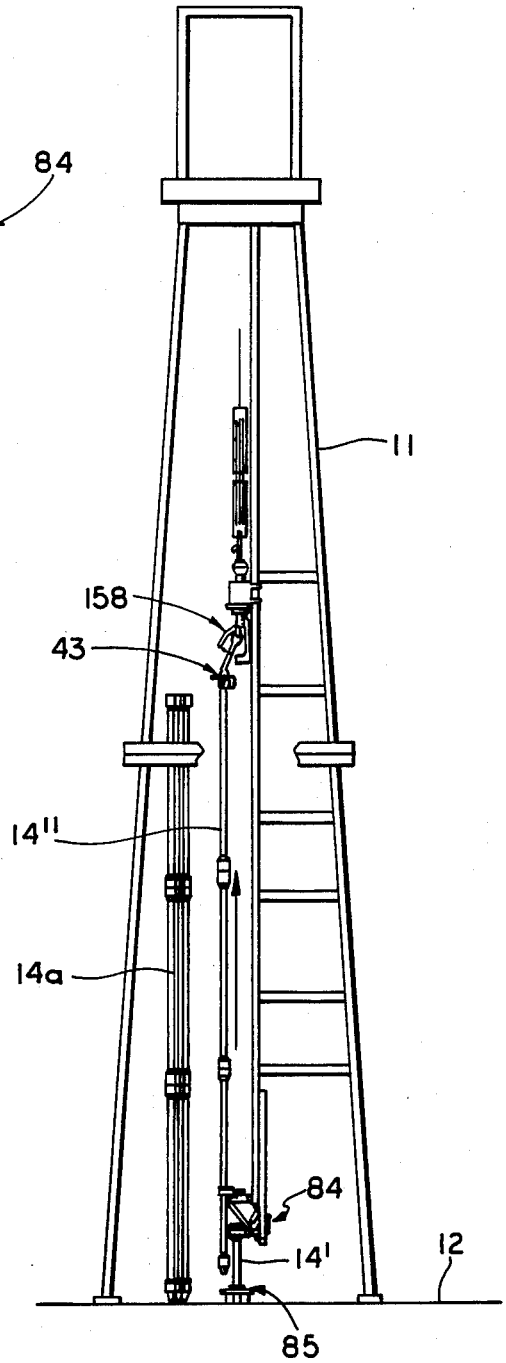
FIG. 9 shows the top drive drilling assembly after it has been connected to a length of pipe to be added to the drill string and has pulled that length of pipe to a location near the upper end of the string.

After the slips have been set, torque wrench 42 is actuated to break the threaded connection between the upper extremity 60 of the drill string and rotary element 49 of the pipe handler. For this purpose, piston and cylinder mechanism 147 (FIG. 3) is actuated to elevate the torque wrench to the broken line position of FIG. 3 in which the upper section 55 of the wrench engages splines 53 of element 49, and the lower section 56 of the torque wrench can grip box end 60 of the drill string by actuation of piston 61 of FIG. 4. With the torque wrench in this condition, piston and cylinder mechanisms 58 are energized to turn section 55 of the torque wrench relative to the drill string and thus break the threaded connection between rotary element 49 of the drilling unit and the string. Motor 31 of the drilling unit is then energized to rapidly spin element 49 in a direction to completely disconnect it from the upper end of the string, freeing the drilling unit and the pipe handling mechanism to be pulled upwardly as represented in FIG. 8 to the top of the rig to pick up a length of pipe 14″ to be added to the string, as represented in FIG. 9. The stand 14″ may be one of a number of stands racked in vertical condition as represented at **14*a* in FIG. 9. Stand 14″ is lifted by engaging elevator 43 with it, and then raising the top drive unit and the connected stand 14″ by upward movement of the traveling block. To facilitate this process, links 45 are desirably actuated by link tilter 158 to their inclined positions of FIGS. 5 and 9, in which the elevator can suspend the add-on stand at a location offset laterally from the well axis 20. As the suspended stand 14″ moves inwardly to the FIG. 9 position, an operator may direct it into engagement with the back-up and stabbing assembly 84, to be located and controlled by that assembly as the top drive unit and stand are elevated and the stand is moved inwardly to the FIG. 11** position of alignment with the upper end of the drill string for connection thereto.

FIG. 8 shows the retracted inactive position in which back-up and stabbing assembly 84 is retained during the actual drilling operation, that is, while the drill string is being rotated by the top drive unit to drill the well. The back-up and stabbing assembly remains in this FIG. 8 position until after the rotary stem 49 of the top drive unit has been disconnected from the upper box end 60 of the drill string and the top drive assembly has been moved upwardly away from the drill string as represented in FIG. 8. As the top drive assembly continues its upward movement toward the position of FIG. 9, back-up and stabbing assembly 84 may be swung from its inactive FIG. 8 position to its active position of FIG. 10.

Assembly 84 includes a carriage 89 which is mounted movably by two parallel vertical auxiliary tracks or rails 90 which may be located slightly to the right of main tracks 27 as viewed in FIGS. 8 through 14 and may be rigidly attached thereto by brackets or other means represented at 91 in FIG. 13. Tracks 90 may have the channel shaped horizontal cross-sectional configuration illustrated in FIG. 13, so that each channel may be engaged at opposite sides by two rollers 92 and 93 of the carriage.

The carriage has a rigid body 94 to which the rollers are rotatably mounted and typically including an essentially tubular rigid member 95 extending horizontally between the two tracks 90 and preferably having the rectangular vertical cross section illustrated in FIG. 14. At its opposite ends, this box-like rectangular member 95 may carry two parallel vertical plates 96, typically having the outline configuration represented in FIG. 14, with the rollers 92 and 93 being carried rotatably by these plates at locations to properly engage the tracks. As will be understood, the two rollers 92 carried by the two plates 96 are mounted for rotation about a common horizontal axis 97, and the second pair of rollers 93 are mounted for rotation about a second horizontal axis 98 parallel to axis 97. The spacing S between the track engaging surfaces 99 of each roller 92 and the corresponding roller 93 is substantially greater than the spacing s between the track surfaces 100 which engage those rollers, so that the entire carriage may swing about axis 97 of wheels 92 between the retracted position of FIG. 8 in which rollers 93 do not engage the tracks and the active position of FIG. 10 in which all of the rollers do engage the tracks.

Carriage 89 and the other components of the back-up and stabbing assembly 84 are power actuated upwardly and downwardly and pivotally by two similar generally vertically extending parallel piston and cylinder mechanisms 101, which may have their cylinders connected pivotally at their upper ends to the inner sides of tracks 90 as represented at 102 and have their piston rods connected pivotally at 103 to the inner sides of plates 96. With the back-up and stabbing assembly in the FIG. 10 active condition, in which all of the rollers 92 and 93 engage the tracks, the assembly 84 can be moved upwardly and downwardly by piston and cylinder mechanisms 101 between the full line position of FIG. 10 and the broken line position of that figure, to engage and grip the upper end 60 of the drill string at any of various different levels, and thus avoid the necessity for precise vertical positioning of that end of the drill string. In the FIG. 10 position, rollers 92 of the carriage engage two horizontal stop shoulders 104 projecting from the tracks, to thereby prevent further downward movement of rollers 92 so that upon continued downward actuation of the pistons of mechanisms 101 the plates are caused to swing about axis 97 of rollers 92 to the FIG. 8 retracted position of the back-up and stabbing assembly. The reverse action of course takes place when the pistons are actuated upwardly, in which event the plates 96 and the remainder of carriage 89 and all parts mounted thereto first swing about axis 97 to the FIG. 10 position, with any additional upward movement of the pistons serving then to shift the back-up and stabbing assembly upwardly to any desired position. In order to assure this type of actuation, the point of connection 103 between each of the pistons of mechanisms 101 and the corresponding plate 96 of carriage 89 is far enough to the right in FIG. 8 to assure that in all positions of the back-up and stabbing assembly the center of gravity CG of the back-up and stabbing assembly is to the left of point 103 and axes 204 of the pistons, and also of course to the right of the pivotal axis 97. The weight of the assembly is thus far enough to the left to assure that the assembly will swing from the FIG. 8 position to the FIG. 10 position by gravity when upward force is exerted by the piston and cylinder mechanisms against the plates at 103.

The rectangular body part 95 of carriage 89 rigidly carries an elongated arm 105 which may be of essentially rectangular vertical section similar to the described configuration of member 95, and which projects along an axis 106 and carries a tong or back-up assembly 107 at its outer end. In the FIGS. 10 and 14 active position of the back-up and stabbing assembly, the longitudinal axis 106 of arm 105 desirably projects directly horizontally from the location of the tracks and intersects the vertical axis 20 of the well and drill string, and in the FIG. 8 inactive position of the back-up and stabbing assembly arm 105 and its axis 106 desirably extend vertically at a location midway between the two tracks 90. At its outer end, arm 105 may have two lugs 108 projecting in opposite directions therefrom, and containing vertical openings **108*a* within which two pivot pins 109 are received to connect a pair of jaws 110 and 111 pivotally to the two ears 108 for swinging movement about vertical axes 112 and 113 of the pins. Each of the jaws 110 and 111 may be formed of two parallel upper and lower rigid plates 114 and 115, rigidly secured together in spaced relation by vertical connectors including two elements 116 carrying gripping dies 117 for engaging the upper joint end 60 of the drill string and retaining it against rotation. At their opposite ends, the plates 114 and 115 of tong arms 110 and 111 are connected pivotally at 118 to the cylinders of a pair of piston and cylinder mechanisms 119, whose pistons are pivotally connected at 120 to one another and to arm 105. Thus, the mechanisms 119 are actuable by pressure fluid to move the jaws 110 and 111** into and out of gripping engagement with the drill pipe.

In addition to the back-up device 107, assembly 84 includes a stabbing unit 121, which engages and locates the add-on pipe stand 14'' during its connection to the drill string. This stabbing unit 121 may include a rigid elongated body member 122 whose longitudinal axis 123 extends parallel to and directly above axis 106 of the back-up tool 107 in the active FIG. 14 position of the parts. This body part 122 is mounted by a parallelogram mechanism 124 for essentially horizontal movement between the positions of FIGS. 10 and 11, while continuously maintaining member 122 and its axis 123 horizontal and parallel to the axis 106 of the back-up tong. Parallelogram mechanism 124 includes a first pair of links 125 connected pivotally at their ends 126 to member 122 for relative pivotal movement about a horizontal axis 127 and connected at their lower ends 128 for relative pivotal movement about a horizontal axis 129. A second similar pair of parallelogram links 130 are connected at 140 to member 122 for relative pivotal movement about axis 141 and are connected at their lower ends 142 to arm 105 for relative pivotal movement about an axis 143. All of the axes 127, 129, 141 and 143 are horizontal and parallel to one another, and are perpendicular to a plane containing the longitudinal axes 106 and 123 of parts 105 and 122. As seen in FIG. 12, the two links 125 may flare to an increased spacing at their lower ends, and the links 130 may similarly flare to an increased spacing at their lower ends.

The main body 122 of the stabbing unit 121 carries at its upper side two jaws 144 and 145, which are connected pivotally to member 122 at 146 and 147 for relative pivotal movement about spaced vertical axes between the broken line and full line positions of FIG. 12. Two springs 148 urge these jaws relatively toward one another and to the full line positions of FIG. 12, and yieldingly resist spreading of the jaws to their broken line positions. For this purpose, the springs bear at opposite ends against vertical plate portions 149 of the jaws and two lugs 150 attached to member 122 and projecting outwardly therefrom. At their inner sides, the jaws have vertically extending surfaces 151 which converge progressively toward one another in a rightward direction as viewed in FIG. 12. Inwardly beyond those surfaces 151, the two jaws have recesses 152 facing one another for receiving opposite side portions of the pipe 14" in a manner effectively locating it against horizontal movement. Each of these recesses 152 may be defined by two vertically extending surfaces 153 disposed at an angle to one another in the configuration illustrated in FIG. 12.

The stabbing unit is actuated between its FIG. 10 and FIG. 11 positions by a piston and cylinder mechanism 154, whose cylinder and piston may be connected respectively to arm 105 and one of the links 130 in the manner illustrated in FIG. 14. This piston and cylinder mechanism may be constructed to have a limited range of travel determining the positions to which the stabbing unit is actuated in the FIGS. 10 and 11 settings. In the FIG. 10 condition, the vertical axis 155 of the pipe receiving vertical passageway defined by the two recesses 152 in jaws 144 and 145 is offset to the left of main axis 20 of the well and pipe string. In the FIG. 11 position, the piston and cylinder mechanism 154 positively holds jaws 144 and 145 in a position in which the vertical axis of the pipe receiving passage or recess formed by recesses 152 in the jaws, and thus the axis of a pipe held thereby, is in direct vertical alignment with the main well axis 20.

To describe briefly a cycle of operation of the illustrated apparatus, during an actual drilling operation the drilling unit 19 and connected pipe handling apparatus and drill string 14 are advanced progressively downwardly along rails 27, with the drill string and bit being driven rotatably by the motor of unit 19, and with this apparatus advancing downwardly through the position of FIG. 1 and ultimately to the FIG. 6 lowermost position adjacent the rig floor. During such drilling, the back-up and stabbing assembly 84 is in its retracted position of FIG. 8, and is held in that condition by piston and cylinder mechanisms 101, and is so located as to avoid interference with the operation of the drilling equipment. When the drilling has progressed to the FIG. 6 condition, the drill string is pulled upwardly off of the bottom of the well, by elevation of the drilling unit and string to the FIG. 7 position, and the string is then suspended in that condition independently of the drilling unit by actuation of slip mechanism 85 to its active gripping condition. The drilling unit and the pipe handler mechanism suspended thereby may then be disconnected from the upper end 60 of the string by first actuating cylinder 147 to raise torque wrench 42 to its broken line position 55' of FIG. 3, then utilizing the torque wrench to break the threaded connection, and finally energizing motor 31 to unscrew element 49 completely from the string. Elevator 43 is then opened and thus detached from the drill string, and the drilling unit and connected parts are pulled upwardly as represented in FIG. 8 and to the FIG. 9 position. After the drilling unit and pipe handling mechanism have been pulled upwardly away from the upper end 60 of the string, piston and cylinder mechanisms 101 are fluid actuated to exert upward force on the carriage of assembly 84 at 103 and thus swing that assembly from the FIG. 8 position to the active FIG. 10 position as previously discussed. If the upper joint end 60 of the drill string is at an elevation somewhat above that represented in FIG. 10, the upward force exerted by piston and cylinder mechanisms 101 may be continued to pull the back-up and stabbing assembly 84 upwardly to a position such as the broken line position of FIG. 10, or any position intermediate the full line and broken line positions of FIG. 10 in which the back-up tong assembly 107 may be properly located for engaging and gripping joint end 60. This movement by the piston and cylinder mechanism 101 is halted at that proper position, and the cylinder units 119 of back-up tool 107 are then actuated to move the right ends of jaws 110 and 111 away from one another as viewed in FIG. 13, and thereby clamp the outer ends of the jaws and the gripping elements 117 carried thereby tightly against the upper joint end 60 of the drill string in a manner retaining it against rotation. Dies 117 are of a type having teeth designed to prevent rotary movement of the pipe when the tong grips the pipe.

With the upper box end of the drill string thus restrained against rotation by the tong device 107, cylinder 154 is actuated to move stabbing unit 121 leftwardly to the extended position of FIGS. 10 and 14. By this time, the elevator 43 of the top drive drilling assembly has been connected to the upper end of the add-on length of pipe 14", with the elevator in its laterally displaced position of FIG. 9. The pipe while suspended by elevator 43 is swung horizontally into jaws 144 and 145, as from the broken line position of those figures. During such movement, the pipe engages converging surfaces 151 of the jaws and spreads them apart against the force of springs 148, as the pipe moves into the confining passageway formed by opposed recesses 152 in the jaws. The springs return the jaws together against the pipe and thus lock the pipe in place within the jaws. The surfaces 153 of the jaws extend vertically and closely embrace the pipe to effectively guide it for only upward and downward movement as the top drive drilling unit pulls the pipe upwardly from the level represented in FIG. 10 to the broken line position of FIG. 11, after which piston and cylinder mechanism 154 is actuated to move jaws 144 and 145 and the contained pipe rightwardly to the full line position of FIG. 11 in direct vertical and axial alignment with box end 60 of the drill string.

While the add-on pipe stand 14" is retained by the stabbing unit 121 in the FIG. 11 position of axial alignment with the upper box end 60 of the drill string, the top drive drilling unit 19 and mechanism suspended thereby are lowered along axis 20, to stab the lower end of stand 14" into the upper joint end 60 of the drill string, as represented at 14" in FIG. 11. Continued lowering of the top drive unit allows the elevator 43 to slide downwardly along the outside of the upper end portion of stand 14", ultimately to a condition in which the lower end of the rotary stem 49 of the top drive unit moves into engagement with the upper end of stand 14". The threaded connections at the upper and lower ends of stand 14" are then made up by powered rotation of element 49 by motor 31, with the drill string being retained against rotation by back-up tool 107. After the threaded connections have been fully made up in this manner the power cylinders 119 are actuated to open jaws 110 and 111 far enough to allow the back-up and stabbing assembly 84 to swing about horizontal axis 97 from the FIG. 14 position to the retracted FIG. 8 position. Such swinging movement is effected by actuation of power cylinders 101 to exert downward force on carriage 89 at the locations 103 in a manner first moving the entire assembly 84 downwardly until rollers 92 engage stop shoulders 104, and then pivoting the entire assembly 84 about the axis of those rollers as previously discussed. During such swinging movement, the force exerted by piston and cylinder mechanisms 101 is great enough to overcome the resistance of springs 148 of stabbing unit 121, so that as the stabbing unit 121 swings in a clockwise direction as viewed in FIG. 11 the pipe stand 14" engages two of the converging surfaces 153 of jaws 144 and 145 and cams those jaws apart just far enough to allow the stabbing unit to move completely out of engagement with pipe stand 14". When the back-up and stabbing assembly reaches the FIG. 8 position, it is completely out of the path of vertical movement of the top drive drilling assembly and connected parts, so that the drilling operation may then be resumed, with powered rotation of the string by the top drive drilling unit and simultaneous progressive downward movement of the string until the apparatus again reaches the FIG. 6 condition in which the above discussed series of steps are repeated to add another stand to the upper end of the string.

An operator may control the entire operation of back-up and stabbing assembly 84 remotely from the rig floor, typically by actuation of three valves represented at 170, 171 and 172 in FIG. 1, controlling the delivery of pressure fluid to and from cylinders 101, 119 and 154 respectively.

While a certain specific embodiment of the present invention has been disclosed as typical, the invention is of course not limited to this particular form, but rather is applicable broadly to all such variations as fall within the scope of the appended claims.

I claim:

1. Well apparatus comprising:

a back-up tool for holding the upper threaded end of a string of well pipe against rotation as an additional length of pipe is connected thereto;

means mounting said back-up tool for movement between an active position for engaging and holding said upper end of the pipe string and an inactive position offset laterally with respect to the string;

a stabbing unit for locating said additional length of pipe during connection to the string; and means mounting said stabbing unit for movement with said back-up tool between said active and inactive positions thereof and for movement relative to said back-up tool, in said active position thereof, between a first position of the stabbing unit for engaging and holding said additional length of pipe at a location offset laterally with respect to the back-up tool and a second position locating the additional length of pipe in alignment with the back-up tool for connection to the string;

said means mounting the back-up tool being constructed to mount said tool for vertical movement in said active position of the back-up tool in addition to said movement of the back-up tool between said active and inactive positions, to thereby engage said upper threaded end of the pipe string and hold is against rotation at different levels;

said means mounting the stabbing unit connecting the stabbing unit to said back-up tool for vertical movement therewith in said active position of the back-up tool.

2. Well apparatus comprising:

a back-up tool for holding the upper threaded end of a string of well pipe against rotation as an additional length of pipe is connected thereto;

means mounting said back-up tool for movement between an active position for engaging and holding said upper end of the pipe string and an inactive position offset laterally with respect to the string;

a stabbing unit for locating said additional length of pipe during connection to the string; and means mounting said stabbing unit for movement with said back-up tool between said active and inactive positions thereof and for movement relative to said back-up tool, in said active position thereof, between a first position of the stabbing unit for engaging and holding said additional length of pipe at a location offset laterally with respect to the back-up tool and a second position locating the additional length of pipe in alignment with the back-up tool for connection to the string;

said means mounting said back-up tool being constructed to mount the back-up tool for vertical movement in the active position of the back-up tool and through a predetermined range of movement, and for movement between said active and inactive positions at an end of said range of vertical movement.

3. Well apparatus comprising:

a back-up tool for holding the upper threaded end of a string of well pipe against rotation as an additional length of pipe is connected thereto;

means mounting said back-up tool for movement between an active position for engaging and holding said upper end of the pipe string and an inactive position offset laterally with respect to the string;

a stabbing unit for locating said additional length of pipe during connection to the string: and means mounting said stabbing unit for movement with said back-up tool between said active and inactive positions thereof and for movement relative to said back-up tool, in said active position thereof, between a first position of the stabbing unit for engaging and holding said additional length of pipe at a location offset laterally with respect to the back-up tool and a second position locating the additional length of pipe in alignment with the back-up tool for connection to the string;

said means mounting said back-up tool including a generally vertically extending guide structure guiding the back-up tool for upward and downward through a predetermined range of movement to engage said upper end of the string at different elevations, and stop means for limiting vertical movement of the back-up tool near an end of said range of upward and downward movement in a relation causing actuation of the back-up tool between said active and inactive positions thereof.

4. Well apparatus comprising:

a back-up tool for holding the upper threaded end of a string of well pipe against rotation as an additional length of pipe is connected thereto;

means mounting said back-up tool for movement between an active position for engaging and holding said upper end of the pipe string and an inactive position offset laterally with respect to the string;

a stabbing unit for locating said additional length of pipe during connection to the string; and means mounting said stabbing unit for movement with said back-up tool between said active and inactive positions thereof and for movement relative to said back-up tool, in said active position thereof, between a first position of the stabbing unit for engaging and holding said additional length of pipe at a location offset laterally with respect to the back-up tool and a second position locating the additional length of pipe in alignment with the back-up tool for connection to the string;

said means mounting the back-up tool including a vertically extending guide structure, rollers attached to said back-up tool and engaging in opposite directions against said guide structure in a relation guiding the back-up tool for vertical movement along the guide structure in said active position of the back-up tool to enable engagement of the back-up tool with said upper end of the string at different elevations, and stop means for limiting vertical movement of one of said rollers at a predetermined location in a relation causing the back-up tool and another of the rollers to swing essentially about said one roller between said active and inactive positions of the back-up tool.

5. Well apparatus comprising:

a back-up tool for holding the upper threaded end of a string of well pipe against rotation as an additional length of pipe is connected thereto;

means mounting said back-up tool for movement between an active position for engaging and holding said upper end of the pipe string and an inactive position offset laterally with respect to the string;

a stabbing unit for locating said additional length of pipe during connection to the string; and means mounting said stabbing unit for movement with said back-up tool between said active and inactive positions thereof and for movement relative to said back-up tool, in said active position thereof, between a first position of the stabbing unit for engaging and holding said additional length of pipe at a location offset laterally with respect to the back-up tool and a second position locating the additional length of pipe in alignment with the back-up tool for connection to the string;

said means mounting the stabbing unit including a parallelogram linkage connecting said stabbing unit to said back-up tool for movement generally horizontally relative thereto in the active position of the back-up tool.

6. Well drilling apparatus comprising:

a rig having a rig floor;

a top drive unit including a rotary drive element detachably connectable to an upper threaded end of drill string and a motor for driving said element to turn the string and drill a well, said unit being movable downwardly with the string to a position in which said upper end of the string is in a lowermost position thereof near the rig floor;

means for supporting said string independently of the top drive unit with said upper end of the string pulled upwardly to an elevated position above said lowermost position thereof and in which said upper end of the drill string is not easily accessible to a person standing on the rig floor;

a back-up tool for holding the upper threaded end of the drill string in said elevated position against rotation as an additional length of pipe is connected thereto;

means mounting said back-up tool for movement between an active position for engaging and holding said upper end of the drill string in said elevated position thereof and an inactive position offset laterally with respect to the string;

a stabbing unit for locating said additional length of pipe during connection to the string; and means mounting said stabbing unit for movement relative to said back-up tool, in said active position of the back-up tool, between a first position of the stabbing unit for engaging and holding said additional length of pipe at a location offset laterally with respect to the back-up tool while the latter holds said upper end of the drill string in said elevated position, and a stabbing position locating the additional length of pipe in alignment with the back-up tool for connection to the string;

said means mounting the back-up tool being constructed to mount said tool for vertical movement in said active position of the back-up tool in addition to said movement of the back-up tool between said active and inactive positions, to engage said upper threaded end of the drill string and hold it against rotation at different levels.

7. Well drilling apparatus comprising:

a rig having a rig floor;

a top drive unit including a rotary drive element detachably connectable to an upper threaded end of drill string and a motor for driving said element to turn the string and drill a well, said unit being movable downwardly with the string to a position in which said upper end of the string is in a lowermost position thereof near the rig floor;

means for supporting said string independently of the top drive unit with said upper end of the string pulled upwardly to an elevated position above said lowermost position thereof and in which said upper end of the drill string is not easily accessible to a person standing on the rig floor;

a back-up tool for holding the upper threaded end of the drill string in said elevated position against rotation as an additional length of pipe is connected thereto;

means mounting said back-up tool for movement between an active position for engaging and holding said upper end of the drill string in said elevated position thereof and an inactive position offset laterally with respect to the string;

a stabbing unit for locating said additional length of pipe during connection to the string; and means mounting said stabbing unit for movement relative to said back-up tool, in said active position of the back-up tool, between a first position of the stabbing unit for engaging and holding said additional length of pipe at a location offset laterally with respect to the back-up tool while the latter holds said upper end of the drill string in said elevated position, and a stabbing position locating the additional length of pipe in alignment with the back-up tool for connection to the string;

said means mounting the back-up tool being constructed to mount said tool for vertical movement in said active position of the back-up tool in addition to said movement of the back-up tool between said active and inactive positions, to engage said upper threaded end of the drill string and hold it against rotation at different levels;

said means mounting the stabbing unit connecting the stabbing unit to said back-up tool for vertical movement therewith in said active position of the back-up tool, in addition to said movement of the stabbing unit relative to the back-up tool between said first and stabbing positions.

8. Well drilling apparatus comprising:

a rig having a rig floor;

a top drive unit including a rotary drive element detachably connectable to an upper threaded end of drill string and a motor for driving said element to turn the string and drill a well, said unit being movable downwardly with the string to a position in which said upper end of the string is in a lowermost position thereof near the rig floor;

means for supporting said string independently of the top drive unit with said upper end of the string pulled upwardly to an elevated position above said lowermost position thereof and in which said upper end of the drill string is not easily accessible to a person standing on the rig floor;

a back-up tool for holding the upper threaded end of the drill string in said elevated position against rotation as an additional length of pipe is connected thereto;

means mounting said back-up tool for movement between an active position for engaging and holding said upper end of the drill string in said elevated position thereof and an inactive position offset laterally with respect to the string;

a stabbing unit for locating said additional length of pipe during connection to the string; and means mounting said stabbing unit for movement relative to said back-up tool, in said active position of the back-tool, between a first position of the stabbing unit for engaging and holding said additional length of pipe at a location offset laterally with respect to the back-up tool while the latter holds said upper end of the drill string in said elevated position, and a stabbing position locating the additional length of pipe in alignment with the back-up tool for connection to the string;

said means mounting said back-up tool being constructed to mount the back-up tool for vertical movement in said active position of the back-up tool and through a predetermined range of movement, and for movement between said active and inactive positions at an end of said range of vertical movement.

9. Well drilling apparatus comprising:

a rig having a rig floor;

a top drive unit including a rotary drive element detachably connectable to an upper threaded end of drill string and a motor for driving said element to turn the string and drill a well, said unit being movable downwardly with the string to a position in which said upper end of the string is in a lowermost position thereof near the rig floor;

means for supporting said string independently of the top drive unit with said upper end of the string pulled upwardly to an elevated position above said lowermost position thereof and in which said upper end of the drill string is not easily accessible to a person standing on the rig floor;

a back-up tool for holding the upper threaded end of the drill string in said elevated position against rotation as an additional length of pipe is connected thereto;

means mounting said back-up tool for movement between an active position for engaging and holding said upper end of the drill pipe string in said elevated position thereof and an inactive position offset laterally with respect to the string;

a stabbing unit for locating said additional length of pipe during connection to the string; and means mounting said stabbing unit for movement relative to said back-up tool, in said active position of the back-up tool, between a first position of the stabbing unit for engaging and holding said additional length of pipe at a location offset laterally with respect to the back-up tool while the latter holds said upper end of the drill string in said elevated position, and a stabbing position locating the additidonal length of pipe in alignment with the back-up tool for connection to the string;

said means mounting said back-up tool including a generally vertical extending guide structure guiding the back-up tool for upward and downward movement through a predetermined range of movement to engage said upper end of the drill string at different elevations, and stop means for limiting vertical movement of the back-up tool near an end of said range of upward and downward movement and in a relation causing actuation of the back-up tool between said active and inactive position thereof.

10. Well drilling apparatus comprising:

a rig having a rig floor;

a top drive unit including a rotary drive element detachably connectable to an upper threaded end of drill string and a motor for driving said element to turn the string and drill a well, said unit being movable downwardly with the string to a position in which said upper end of the string is in a lowermost position thereof near the rig floor;

means for supporting said string independently of the top drive unit with said upper end of the string pulled upwardly to an elevated position above said lowermost position thereof and in which said upper end of the drill string is not easily accessible to a person standing on the rig floor;

a back-up tool for holding the upper threaded end of the drill string in said elevated position against rotation as an additional length of pipe is connected thereto;

means mounting said back-up tool for movement between an active position for engaging and holding said upper end of the drill string in said elevated position thereof and an inactive position offset laterally with respect to the string;

a stabbing unit for locating said additional length of pipe during connection to the string; and means mounting said stabbing unit for movement relative to said back-up tool, in said active position of the back-up tool, between a first position of the stabbing unit for engaging and holding said additional length of pipe at a location offset laterally with respect to the back-up tool while the latter holds said upper end of the drill string in said elevated position, and a stabbing position locating the additional length of pipe in alignment with the back-up tool for connection to the string;

said means mounting the back-up tool including a vertically extending guide structure, rollers attached to said back-up tool and engaging in opposite directions against said guide structure in a relation guiding the back-up tool for vertical movement along the guide structure in said active position of the back-up tool to enable engagement of the back-up tool with said upper end of the drill string at different elevations, and stop means for limiting vertical movement of one of said rollers at a predetermined location in a relation causing the back-up tool and another of the rollers to swing essentially about said one roller between said active and inactive positions of the back-up tool.

11. Well drilling apparatus comprising:

a rig having a rig floor;

a top drive unit including a rotary drive element detachably connectable to an upper threaded end of drill string and a motor for driving said element to turn the string and drill a well, said unit being movable downwardly with the string to a position in which said upper end of the string is in a lowermost position thereof near the rig floor;

means for supporting said string independently of the top drive unit with said upper end of the string pulled upwardly to an elevated position above said lowermost position thereof and in which said upper end of the drill string is not easily accessible to a person standing on the rig floor;

a back-up tool for holding the upper threaded end of the drill string in said elevated position against rotation as an additional length of pipe is connected thereto;

means mounting said back-up tool for movement between an active position for engaging and holding said upper end of the drill string in said elevated position thereof and an inactive position offset laterally with respect to the string;

a stabbing unit for locating said additional length of pipe during connection to the string; and means mounting said stabbing unit for movement relative to said back-up tool, in said active position of the back-up tool, between a first position of the stabbing unit for engaging and holding said additional length of pipe at a location offset laterally with respect to the back-up tool whole the latter holds said upper end of the drill string in said elevated position, and a stabbing position locating the additional length of pipe in alignment with the back-up tool for connection to the string;

said means mounting the stabbing unit including a parallelogram linkage connecting said stabbing unit to said back-up tool for movement generally horizontally relative thereto in the active position of the back-up tool.

12. Well apparatus for use in connecting an additional length of pipe to the upper threaded end of a string of well pipe which extends downwardly along an axis into a well, comprising:

a back-up tool for holding the upper threaded end of said pipe string against rotation about said axis as said additional length of pipe is connected thereto;

means mounting said back-up tool for movement relative to the pipe string between an active position for engaging and holding against rotation said upper end of the pipe string, and an inactive position offset laterally with respect to the string;

a stabbing unit for locating said additional length of pipe in alignment with said string during connection to the string; and means connecting said stabbing unit to said back-up tool for movement with the back-up tool relative to the string between said active and inactive positions of the back-up tool, and also for movement relative to said back-up tool, in said active position thereof, between a first position of the stabbing unit for engaging and holding said additional length of pipe at a location offset laterally with respect to the back-up tool and a second position locating the additional length of pipe in alignment with the back-up tool for connection to the string.

13. Well apparatus as recited in claim 12, in which said means mounting the back-up tool are constructed to mount said tool and said stabbing unit for vertical movement in said active position of the back-up tool in addition to movement between said active and inactive positions, to engage said upper threaded end of the pipe string and hold it against rotation at different levels.

14. Well apparatus comprising:

support means for suspending a string of well pipe having an upper threaded end in a position of extension along an axis and downwardly into a well;

a back-up tool for holding the upper threaded end of said pipe string while suspended by said support means against rotation about said axis as an additional length of pipe is connected thereto;

means mounting said back-up tool for movement relative to said support means and said pipe string suspended thereby between an active position of alignment with the support means and suspended pipe string for engaging and holding against rotation said upper end of the pipe string, and an inactive position offset laterally with respect to said support means and pipe string suspended thereby;

a stabbing unit for locating said additional length of pipe in alignment with said string during connection to the string; and means connecting said stabbing unit to said back-up tool for movement with the back-up tool relative to said support means and said pipe string suspended thereby between said active position in which the back-up tool is aligned with the support means and string and said laterally offset inactive position, and also for movement relative to said back-up tool, in said active position thereof, between a. first position of the stabbing unit for engaging and holding said additional length of pipe at a location offset laterally with respect to the back-up tool and support means and string and a second position locating the additional length of pipe in alignment with the back-up tool and support means and string for connection to the string.

15. Well apparatus as recited in claim 14, in which said means mounting the back-up tool are constructed to mount said tool and said stabbing unit for vertical movement in said active position of the back-up tool in addition to movement between said active and inactive position, to engage said upper threaded end of the pipe string and hold is against rotation at different levels.

16. Well apparatus as recited in claim 14, including powered means for actuating said back-up tool between said active and inactive positions thereof.

17. Well apparatus as recited in claim 14, including powered means for moving said stabbing unit between said first and second positions thereof relative to said back-up tool.

18. Well apparatus as recited in claim 14, including first powered means for moving said back-up tool with said stabbing unit between said active and inactive positions of the back-up tool, and second powered means for moving said stabbing unit between said first and second positions thereof relative to said back-up tool while the back-up tool is in its active position.

19. Well apparatus as recited in claim 14, in which said stabbing unit includes two jaws engageable with opposite sides of said additional length of pipe to grip it and locate it and guide it for vertical movement downwardly into engagement with the upper end of the drill string.

20. Well apparatus as recited in claim 14, in which said stabbing unit is constructed to hold said additional length of pipe against horizontal movement relative to the stabbing unit while permitting vertical movement of said additional length of pipe relative to the stabbing unit for connection to said upper end of the drill string.

21. Well drilling apparatus comprising:

a top drive unit including a rotary drive element detachably connectable to an upper threaded end of drill string and motor for driving said element rotatably about an axis to turn the string about said axis and drill a well;

support means for suspending said string independently of the top drive unit and while detached therefrom;

a back-up tool for holding the upper threaded end of the drill string against rotation as an additional length of pipe is connected thereto;

means mounting said back-up tool for movement relative to said top drive unit and said string suspended by said support means between an active position of alignment with said axis of rotation of said rotary drive element and with said string to engage said upper end of the string and hold it against rotation about said axis, and an inactive position offset laterally with respect to said axis of rotation of said element and with respect to said string;

a stabbing unit for locating said additional length of pipe during connection to the string; and means connecting said stabbing unit to said back-up tool for movement with the back-up tool relative to said top drive unit and said string suspended by said support means between said active and inactive positions of the back-up tool, and also for movement relative to said back-up tool, in said active position of the back-up tool between a first position of the stabbing unit for engaging and holding said additional length of pipe at a location offset laterally with respect to the back-up tool, and a stabbing position locating the additional length of pipe in alignment with the back-up tool for connection to the string.

22. Well apparatus as recited in claim 21, including powered means for moving said back-up tool with said stabbing unit between said active and inactive positions of the back-up tool, and for moving said stabbing unit between said first and stabbing positions thereof relative to said back-up tool while the back-up tool is in its active position.

23. Well apparatus as recited in claim 21, in which said stabbing unit includes two jaws engageable with opposite sides of said additional length of pipe to grip it and locate it and guide the stabbing unit for vertical movement downwardly into engagement with the upper end of the drill string.

24. Well drilling apparatus, comprising:

a rig having a rig floor;

a top drive unit including a rotary drive element detachably connectable to an upper threaded end of a drill string and a motor for driving said element to turn the string and drill a well, said unit being movable downwardly with the string to a position in which said upper end of the string is in a lowermost position thereof near the rig floor;

means for supporting said string independently of the top drive unit with said upper end of the string pulled upwardly to an elevated position above said lowermost position and in which said upper end of the drill string is not easily accessible to a person standing on the rig floor;

a vertically extending guide structure;

a back-up tool for holding the upper threaded end of the drill string against rotation at said elevated position as an additional length of pipe is connected thereto, and including relatively movable jaws engageable with opposite sides of said upper end of the drill string in said elevated position for holding it against rotation;

a carriage structure engaging said guide structure and carrying said back-up tool and guided by the guide structure for upward and downward movement with the back-up tool to enable the latter to engage the upper end of the drill string at different levels;

said carriage structure being constructed to swing about a generally horizontal axis with the back-up tool to move the back-up tool between an active position of engagement with the drill string and an inactive position;

first powered means for moving said carriage structure and back-up tool vertically and swinging them about said generally horizontal axis between said active and inactive positions of the back-up tool;

a stabbling unit for locating said additional length of pipe during connection to the string;

a connection mounting said stabbing unit to said back-up tool for swinging movement therewith about said generally horizontal axis between said active and inactive positions of the back-up tool, and for movement relative to the back-up tool, when the latter is in said active position thereof, between an extended position of the stabbing unit for engaging and holding said additional length of pipe at a location offset laterally with respect to the back-up tool and a stabbing position locating the additional length of pipe in alignment with the back-up tool for connection to the string; and second powered means for actuating said stabbing unit between said extended and stabbing positions relative to the back-up tool.

25. Well apparatus as recited in claim 24, in which said carriage structure includes first and second roller means bearing in opposite directions against said guide structure when the back-up tool is in said active position thereof to guide the carriage structure and back-up tool and stabbing unit for upward and downward movement, there being stop means carried by said guide structure for limiting vertical movement of one of said roller means at a predetermined location and in a relation thereafter causing swinging movement of said carriage structure and said back-up tool and said stabbing unit essentially about said one roller means to move the back-up tool between said active and inactive positions thereof.

26. Well apparatus as recited in claim 24, in which said stabbing unit includes two jaws spring pressed toward one another for receiving and gripping said additional length of pipe and at least one of which jaws contains a recess locating the additional length of pipe against horizontal movement relative to the stabbing unit while guiding said additional length of pipe for vertical movement relative to the stabbing unit during connection to said upper end of the drill string.

27. Well apparatus as recited in claim 24, in which said connection includes a parallelogram linkage attaching said stabbing unit to said back-up tool for generally horizontal movement relative to the back-up tool between said extended and stabbing positions of the stabbing unit in said active position of the back-up tool.

28. Well apparatus as recited in claim 27, in which said carriage structure includes first and second roller means bearing in opposite directions against said guide structure when the back-up tool is in said active position thereof to guide the carriage structure and back-up tool and stabbing unit for upward and downward movement, there being stop means carried by said guide structure for limiting vertical movement of one of said roller means at a predetermined location and in a relation thereafter causing swinging movement of said carriage structure and said back-up tool and said stabbing unit essentially about said one roller means to move the back-up tool between said active and inactive positions thereof.

29. Well apparatus as recited in claim 28, in which said stabbing unit includes two jaws spring pressed toward one another for receiving and gripping said additional length of pipe and at least one of which jaws contains a recess locating the additional length of pipe against horizontal movement relative to the stabbing unit while guiding said additional length of pipe for vertical movement relative to the stabbing unit during connection to said upper end of the drill string.

30. Well apparatus comprising:

a vertically extending guide structure;

a back-up tool for holding the upper threaded end of a string of well pipe against rotation as an additional length of pipe is connected thereto, and including relatively movable jaws engageable with opposite sides of said upper end of the string for holding it against rotation;

a carriage structure engaging said guide structure and carrying said back-up tool and guided by the guide structure for upward and downward movement with the back-up tool to enable the latter to engage the upper end of the string at different levels;

said carriage structure being constructed to swing about a generally horizontal axis with the back-up tool to move the back-up tool between an active position of engagement with the pipe string and an inactive position;

first powered means for moving said carriage structure and back-up tool vertically and swinging them about said generally horizontal axis between said active and inactive positions of the back-up tool;

a stabbing unit for locating said additional length of pipe during connection to the string;

a connection mounting said stabbing unit to said back-up tool for swinging movement therewith about said generally horizontal axis between said active and inactive positions of the back-up tool, and for movement relative to the back-up tool, when the latter is in said active position thereof, between an extended position of the stabbing unit for engaging and holding said additional length of pipe at a location offset laterally with respect to the back-up tool and a stabbing position locating the additional length of pipe in alignment with the back-up tool for connection to the string; and second powered means for actuating said stabbing unit between said extended and stabbing positions relative to the back-up tool.

31. Well apparatus as recited in claim 30, in which said carriage structure includes first and second roller means bearing in opposite directions against said guide structure when the back-up tool is in said active position thereof and guiding the carriage structure and back-up tool and stabbing unit for upward and downward movement, there being stop means carried by said guide structure for limiting vertical movement of one of said roller means at a predetermined location and in a relation thereafter causing swinging movement of said carriage structure and said back-up tool and said stabbing unit essentially about said one roller means to move the back-up tool between said active and inactive positions thereof.

32. Well apparatus as recited in claim 30, in which said stabbing unit includes two jaws spring pressed toward one another for receiving and gripping said additional length of pipe with at least one of which jaws containing a recess locating the additional length of pipe against horizontal movement relative to the stabbing unit while guiding said additional length of pipe for vertical movement relative to the stabbing unit during connection to said upper end of the string.

33. Well apparatus as recited in claim 30, in which said connection includes a parallelogram linkage attaching said stabbing unit to said back-up tool for generally horizontal movement relative to the back-up tool between said extended and stabbing positions of the stabbing unit in said active position of the back-up tool.

34. Well apparatus as recited in claim 33, in which said carriage structure includes first and second roller means bearing in opposite directions against said guide structure when the back-up tool is in said active position thereof to guide the carriage structure and back-up tool and stabbing unit for upward and downward movement, there being stop means carried by said guide structure for limiting vertical movement of one of said roller means at a predetermined location and in a relation thereafter causing swinging movement of said carriage structure and said back-up tool and said stabbing unit essentially about said one roller means to move the back-up tool between said active and inactive positions thereof.

35. Well apparatus as recited in claim 34, in which said stabbing unit includes two jaws spring pressed toward one another for receiving and gripping said additional length of pipe with at least one of which jaws containing a recess locating the additional length of pipe against horizontal movement relative to the stabbing unit while guiding said additional length of pipe for vertical movement relative to the stabbing unit during connection to said upper end of the string.

* * * * *